US011566626B2

(12) United States Patent
Tanaka

(10) Patent No.: US 11,566,626 B2
(45) Date of Patent: Jan. 31, 2023

(54) VACUUM PUMP

(71) Applicant: SHIMADZU CORPORATION, Kyoto (JP)

(72) Inventor: Shingo Tanaka, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 171 days.

(21) Appl. No.: 17/076,495

(22) Filed: Oct. 21, 2020

(65) Prior Publication Data

US 2021/0123448 A1 Apr. 29, 2021

(30) Foreign Application Priority Data

Oct. 28, 2019 (JP) ..... JP2019-195578

(51) Int. Cl.
*F04D 19/04* (2006.01)
*F02G 1/055* (2006.01)

(52) U.S. Cl.
CPC ..... *F04D 19/042* (2013.01); *F02G 1/055* (2013.01)

(58) Field of Classification Search
CPC ..... F04D 19/042
USPC ..... 417/423.4, 373
See application file for complete search history.

(56) References Cited

U.S. PATENT DOCUMENTS 10,233,943 B2 * 3/2019 Moriyama ..... F04D 19/042
2012/0034066 A1 * 2/2012 Kogame ..... F04D 19/042 415/90
2015/0219116 A1 * 8/2015 Tsutsui ..... F04D 29/584 415/175
2016/0160877 A1 * 6/2016 Sakaguchi ..... F04D 19/04 415/177
2017/0227018 A1 * 8/2017 Moriyama ..... F04D 27/004
2018/0245603 A1 * 8/2018 Watanabe ..... F04D 29/083
2018/0306204 A1 * 10/2018 Sakai ..... F04D 29/5813

FOREIGN PATENT DOCUMENTS

EP 3462034 A1 4/2019
JP 2013079602 A 5/2013
JP 2014148977 A 8/2014
WO WO-2008062598 A1 * 5/2008 ..... F04D 19/042

OTHER PUBLICATIONS

Office Action for corresponding CN Application No. 202010882284.7 dated Mar. 21, 2022, with English language machine translation.

* cited by examiner

*Primary Examiner* — Kenneth J Hansen
*Assistant Examiner* — Benjamin Doyle
(74) *Attorney, Agent, or Firm* — Renner, Otto, Boisselle & Sklar, LLP

(57) ABSTRACT

A vacuum pump comprises: a pump main body; a heater provided at the pump main body; a power source device configured to supply power to the pump main body; a cooler provided between the pump main body and the power source device; a connection plate provided between the pump main body and the cooler; a first heat insulating plate arranged between the cooler and the connection plate; and a second heat insulating plate arranged between the pump main body and the connection plate.

12 Claims, 8 Drawing Sheets

Fig. 10

| | COMPARATIVE EXAMPLE (Fig. 9) | FIRST EXAMPLE (Fig. 6) | SECOND EXAMPLE (Fig. 7) |
|---|---|---|---|
| SIMULATION TEMPERATURE | 71.3°C | 84.7°C | 95.0°C |
| PROTOTYPE TEST TEMPERATURE | 70.0°C | 85.0°C | 90.0°C |

VACUUM PUMP

BACKGROUND OF THE INVENTION

1. Technical Field

The present invention relates to a power-source-device-integrated vacuum pump.

2. Background Art

Turbo-molecular pumps as vacuum pumps are used for various vacuuming devices. A power-source-integrated turbo-molecular pump includes a pump main body and a power source device. In a turbo-molecular pump described in Patent Literature 1 (JP-A-2014-148977), a water-cooling device is provided between a pump main body and a power source device to cool each component forming the power source device.

Depending on the type of gas discharged by the turbo-molecular pump, a product adheres to the inside of the pump main body. For this reason, a heater is provided at the pump main body to hold the internal temperature of the pump main body at such a temperature that no product adherence occurs (see, e.g., Patent Literature 2 (JP-A-2013-079602)). With this configuration, degradation of exhaust performance due to product adherence is reduced.

SUMMARY OF THE INVENTION

In the turbo-molecular pump, a connection plate is provided at the pump main body to connect the pump main body and the water-cooling device in some cases. In this structure, a heat insulating plate is provided between the connection plate and the water-cooling device to reduce heat transfer between the pump main body and the water-cooling device.

However, even in a case where the heat insulating plate is provided, heat transfer between the pump main body and the water-cooling device through the connection plate and the heat insulating plate might occur. As a result, it is less likely that the temperature of the pump main body increases to a desired temperature.

An object of the present invention is to provide a vacuum pump configured so that the temperature of a pump main body can be increased to a desired temperature in short time.

A vacuum pump comprises: a pump main body; a heater provided at the pump main body; a power source device configured to supply power to the pump main body; a cooler provided between the pump main body and the power source device; a connection plate provided between the pump main body and the cooler; a first heat insulating plate arranged between the cooler and the connection plate; and a second heat insulating plate arranged between the pump main body and the connection plate.

At least one of the cooler or the connection plate has a first fit-in region in which the first heat insulating plate is fitted, a first clearance is formed between the cooler and the connection plate, and a thickness of the first heat insulating plate is greater than a thickness of the first clearance.

At least one of the pump main body or the connection plate has a second fit-in region in which the second heat insulating plate is fitted, a second clearance is formed between the pump main body and the connection plate, and a thickness of the second heat insulating plate is greater than a thickness of the second clearance.

The pump main body has a first surface facing the connection plate and has an outer peripheral surface, the cooler has a second surface facing the connection plate, the connection plate has, as viewed in a first direction perpendicular to the first surface, a protruding portion protruding outward of the outer peripheral surface of the pump main body, and the first heat insulating plate is arranged between the protruding portion and the second surface of the cooler.

The protruding portion is, as viewed in the first direction, formed to at least partially surround the outer peripheral surface of the pump main body, the first heat insulating plate is, as viewed in the first direction, continuously or intermittently provided to at least partially surround the outer peripheral surface of the pump main body, and the second heat insulating plate is, as viewed in the first direction, continuously or intermittently provided along the outer peripheral surface of the pump main body.

A vacuum pump comprises: a pump main body; a heater provided at the pump main body; a power source device configured to supply power to the pump main body; a cooler provided between the pump main body and the power source device; a connection plate provided between the pump main body and the cooler; and a first heat insulating plate arranged between the cooler and the connection plate. At least one of the cooler or the connection plate has a first fit-in region in which the first heat insulating plate is fitted, a first clearance is formed between the cooler and the connection plate, and a thickness of the first heat insulating plate is greater than a thickness of the first clearance.

The pump main body has an outer peripheral surface, the cooler has an opposing surface facing the connection plate, the connection plate has, as viewed in a first direction perpendicular to the opposing surface, a protruding portion formed to protrude outward of the outer peripheral surface of the pump main body, the first fit-in region is provided at at least one of the cooler or the protruding portion, and the first heat insulating plate is arranged between the cooler and the protruding portion with the first heat insulating plate being fitted in the first fit-in region.

The protruding portion is, as viewed in the first direction, formed to at least partially surround the outer peripheral surface of the pump main body, the first fit-in region is, as viewed in the first direction, continuously or intermittently provided at at least one of the cooler or the protruding portion to at least partially surround the outer peripheral surface of the pump main body, and the first heat insulating plate is arranged between the cooler and the protruding portion with the first heat insulating plate being fitted in the first fit-in region.

A width of the first heat insulating plate is, as viewed in the first direction, equal to or less than a half of a minimum width of the protruding portion.

A distance between an inner edge portion of the first heat insulating plate and the outer peripheral surface of the pump main body is, as viewed in the first direction, equal to or greater than the half of the minimum width of the protruding portion.

According to the present invention, in the vacuum pump, the temperature of the pump main body can be increased to the desired temperature in short time.

BRIEF DESCRIPTION OF THE DRAWINGS

FIG. 10 is a table showing results of first and second examples and the comparative example.

DETAILED DESCRIPTION OF THE EXEMPLARY EMBODIMENTS

Hereinafter, vacuum pumps according to embodiments will be described in detail with reference to the drawings. In the present embodiments, a turbo-molecular pump will be described as an example of the vacuum pump.

(1) First Embodiment

Figure 1:
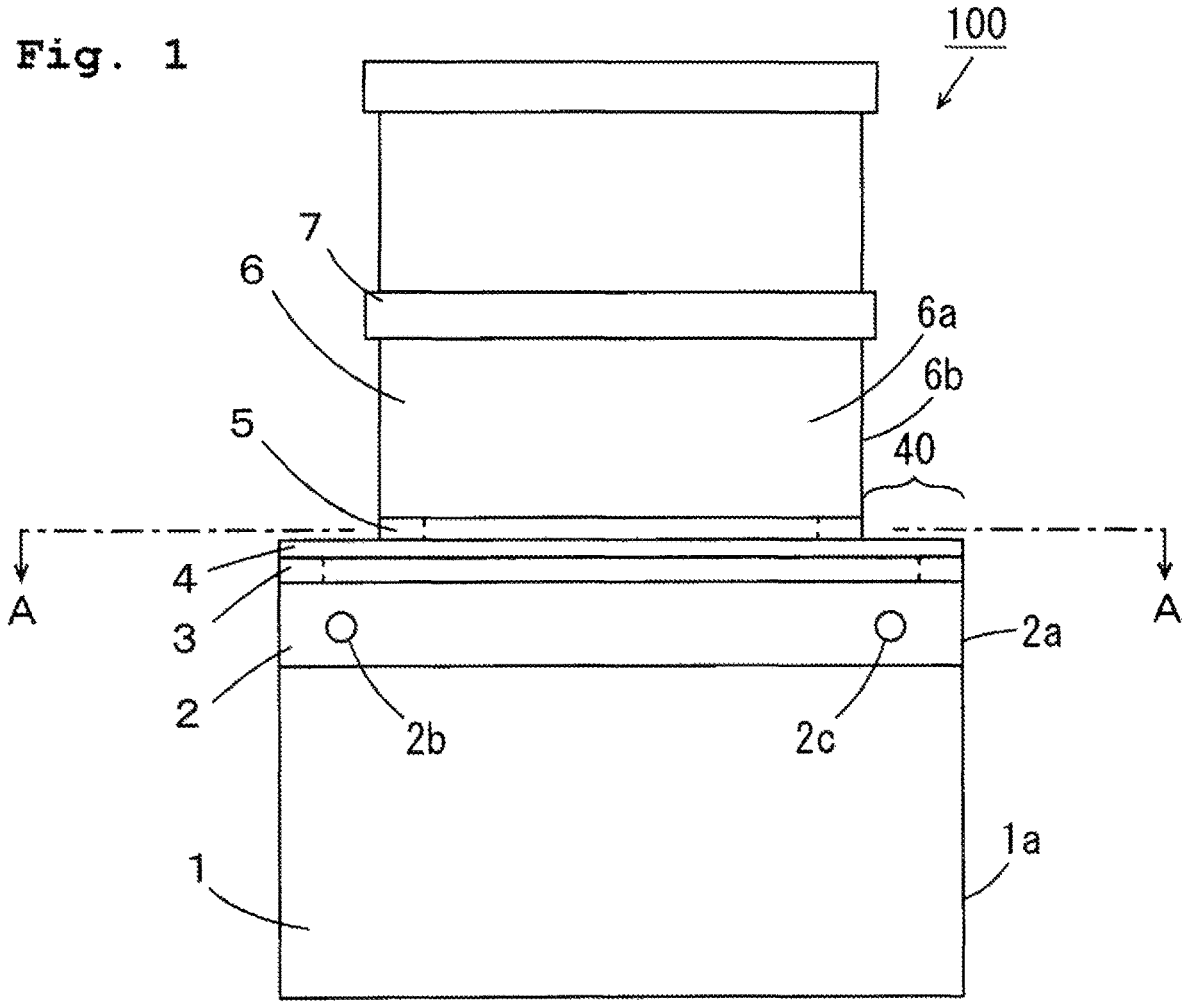
FIG. 1 is a schematic front view of a turbo-molecular pump according to a first embodiment.
Figure 2:
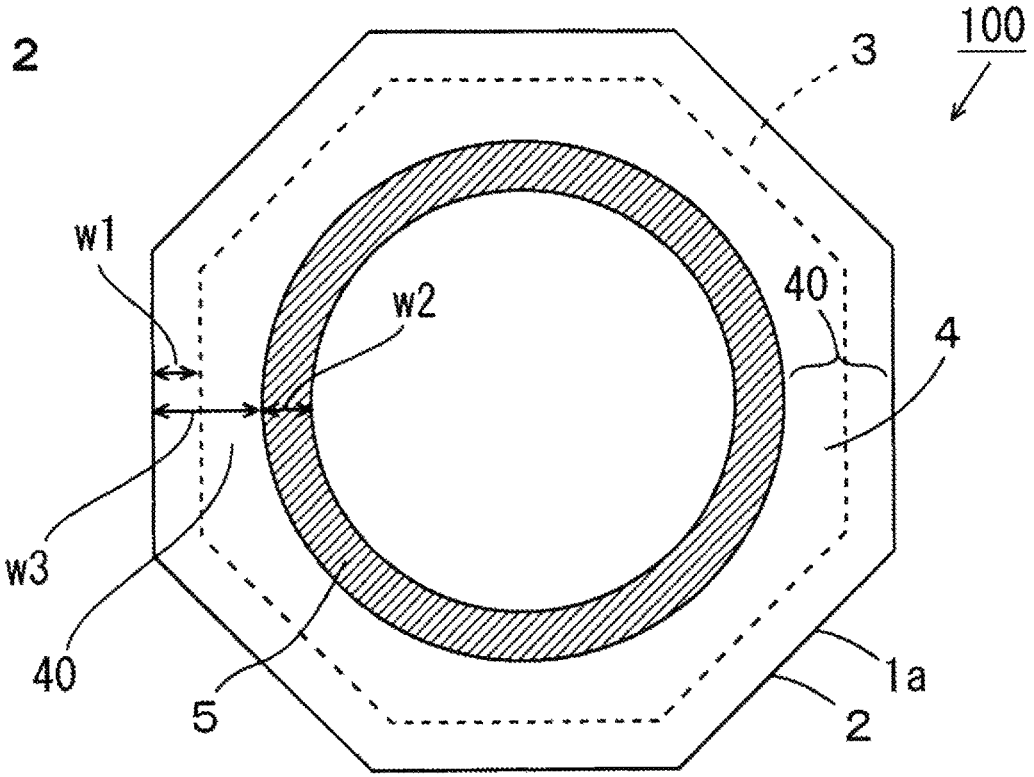
FIG. 2 is an A-A sectional view of the turbo-molecular pump of FIG. 1.

FIG. 1 is a schematic front view of a turbo-molecular pump according to a first embodiment of the present invention. FIG. 2 is an A-A sectional view of the turbo-molecular pump of FIG. 1. As illustrated in FIG. 1, the turbo-molecular pump 100 includes a power source device 1, a cooler 2, a first heat insulating plate 3, a connection plate 4, a second heat insulating plate 5, a pump main body 6, and a heater 7.

The power source device 1 includes a power source device housing 1*a*. The power source device housing 1*a* houses a power source circuit board, a temperature sensor and the like. The power source device 1 supplies power to the pump main body 6 and the heater 7. In the present embodiment, the power source device housing 1*a* has an octagonal outer shape as illustrated in FIG. 2.

As illustrated in FIG. 1, the cooler 2 is provided on an upper surface of the power source device housing 1*a*. The cooler 2 includes a water-cooling jacket 2*a*. A cooling water pipe is provided inside the water-cooling jacket 2*a*. Moreover, a cooling water inlet 2*b* and a cooling water outlet 2*c* are formed outside the water-cooling jacket 2*a*. When cooling water is supplied to the cooling water inlet 2*b*, the cooling water is discharged from the cooling water outlet 2*c* through the cooling water pipe. In this manner, the power source device 1 is cooled. In the present embodiment, the cooler 2 has an octagonal outer shape as illustrated in FIG. 2.

As illustrated in FIG. 1, the connection plate 4 is provided on an upper surface of the cooler 2 through the first heat insulating plate 3. The first heat insulating plate 3 is, for example, made of a resin material having a heat insulating effect. In the present embodiment, the first heat insulating plate 3 has, as illustrated in FIG. 2, an octagonal outer edge and an octagonal inner edge. The first heat insulating plate 3 has a constant width w1. The connection plate 4 is made of metal, for example. In the present embodiment, the connection plate 4 has an octagonal shape.

The power source device 1, the cooler 2, the first heat insulating plate 3, and the connection plate 4 have the same outer shape and the same dimensions as viewed in plane. Thus, side surfaces of the power source device 1, the cooler 2, the first heat insulating plate 3, and the connection plate 4 are flush with each other.

As illustrated in FIG. 1, the pump main body 6 is provided on an upper surface of the connection plate 4 through the second heat insulating plate 5. The second heat insulating plate 5 is, for example, made of a resin material having a heat insulating effect. Moreover, as illustrated in FIG. 2, the second heat insulating plate 5 has a circular ring shape with a width w2. The pump main body 6 of FIG. 1 includes a cylindrical case 6*a*. The case 6*a* is made of, e.g., metal, and houses a rotor, a motor and the like. The connection plate 4 is coupled to the case 6*a* with a bolt or the like. The heater 7 is provided on an outer peripheral surface 6*b* of the case 6*a*. The heater 7 heats the pump main body 6 such that no product adheres to the inside of the case 6*a*.

In the present embodiment, the second heat insulating plate 5 and the case 6*a* of the pump main body 6 have the same outer shape and the same dimensions as viewed in plane. Thus, the second heat insulating plate 5 and the outer peripheral surface 6*b* of the pump main body 6 are flush with each other. The minimum value of a length from the center to an outer edge of the connection plate 4 is longer than the radiuses of the second heat insulating plate 5 and the case 6*a*. With this configuration, the connection plate 4 has, as viewed in plane, a protruding portion 40 protruding outward of the outer peripheral surface 6*b* of the pump main body 6 across an entire circumference. The minimum value (the minimum width of the protruding portion 40) from the outer peripheral surface 6*b* of the pump main body 6 to the outer edge of the connection plate 4 is w3.

Figure 3:
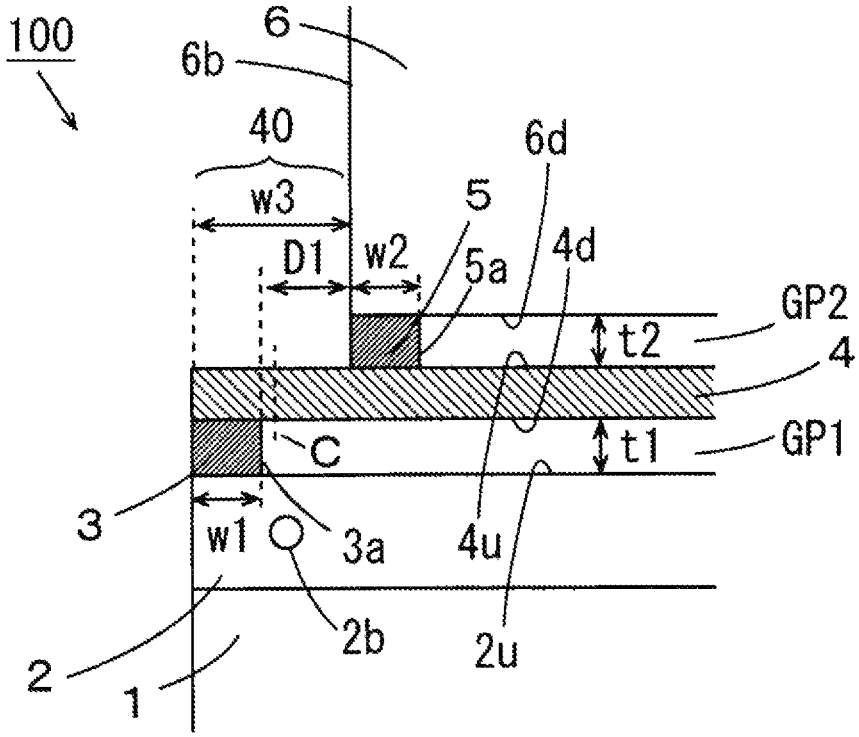
FIG. 3 is a partial enlarged sectional view of the turbo-molecular pump of FIG. 1.

FIG. 3 is a partial enlarged sectional view of the turbo-molecular pump 100 of FIG. 1. A lower surface of the first heat insulating plate 3 and the upper surface 2*u* of the cooler 2 contact each other, and an upper surface of the first heat insulating plate 3 and a lower surface 4*d* of the connection plate 4 contact each other. A clearance GP1 surrounded by an inner peripheral surface 3*a* of the first heat insulating plate 3 is formed between the upper surface 2*u* of the cooler 2 and the lower surface 4*d* of the connection plate 4. The clearance GP1 has a thickness t1. The clearance GP1 acts as a first air heat insulating layer.

A lower surface of the second heat insulating plate 5 and the upper surface 4*u* of the connection plate 4 contact each other, and an upper surface of the second heat insulating plate 5 and a lower surface 6*d* of the pump main body 6 contact each other. A clearance GP2 surrounded by an inner peripheral surface 5*a* of the second heat insulating plate 5 is formed between the upper surface 4*u* of the connection plate 4 and the lower surface 6*d* of the pump main body 6. The clearance GP2 has a thickness t2. The clearance GP2 acts as a second air heat insulating layer.

In the present embodiment, a distance Dl between the outer peripheral surface 6*b* of the pump main body 6 and the inner edge of the first heat insulating plate 3 is equal to or greater than ½ of the minimum width w3 of the protruding portion 40. In an example of FIG. 3, the inner peripheral surface 3*a* of the first heat insulating plate 3 is positioned outside an intermediate point C of the minimum width w3 of the protruding portion 40.

According to the turbo-molecular pump 100 of the first embodiment, the first heat insulating plate 3 arranged between the cooler 2 and the connection plate 4 reduces heat transfer between the cooler 2 and the connection plate 4. Moreover, the second heat insulating plate 5 arranged between the pump main body 6 and the connection plate 4 reduces heat transfer between the pump main body 6 and the connection plate 4. With this configuration, the amount of heat transferred from the pump main body 6 heated by the heater 7 to the cooler 2 through the connection plate 4 is reduced.

Moreover, the clearance GP1 and the clearance GP2 each act as the first and second air heat insulating layers. Generally, the coefficient of thermal conductivity of air is less than the coefficient of thermal conductivity of a solid-state material such as resin. Thus, heat transfer between the cooler 2 and the pump main body 6 is sufficiently reduced by the first air heat insulating layer of the clearance GP1 and the second air heat insulating layer of the clearance GP2.

Further, the first heat insulating plate 3 is arranged between the cooler 2 and the protruding portion 40 of the connection plate 4, and therefore, a path from the pump main body 6 to the cooler 2 by way of the second heat insulating plate 5, the connection plate 4, and the first heat insulating plate 3 is extended. Thus, the amount of heat transferred from the pump main body 6 to the cooler 2 through the first heat insulating plate 3 is further reduced. In addition, the clearance GP1 is formed between the cooler 2 and a center portion of the connection plate 4 excluding the protruding portion 40. Thus, heat transfer in the shortest path between the pump main body 6 and the cooler 2 is sufficiently reduced.

Moreover, the width w1 of the first heat insulating plate 3 is sufficiently smaller than the minimum width w3 of the protruding portion 40 of the connection plate 4. That is, the area of the first heat insulating plate 3 is small. Further, the distance between the first heat insulating plate 3 and the outer peripheral surface 6*b* of the pump main body 6 is sufficiently long. Thus, heat transfer by way of the first heat insulating plate 3 is sufficiently reduced.

As a result, the temperature of the pump main body 6 can be increased to a desired temperature in short time.

(2) Second Embodiment

Figure 4:
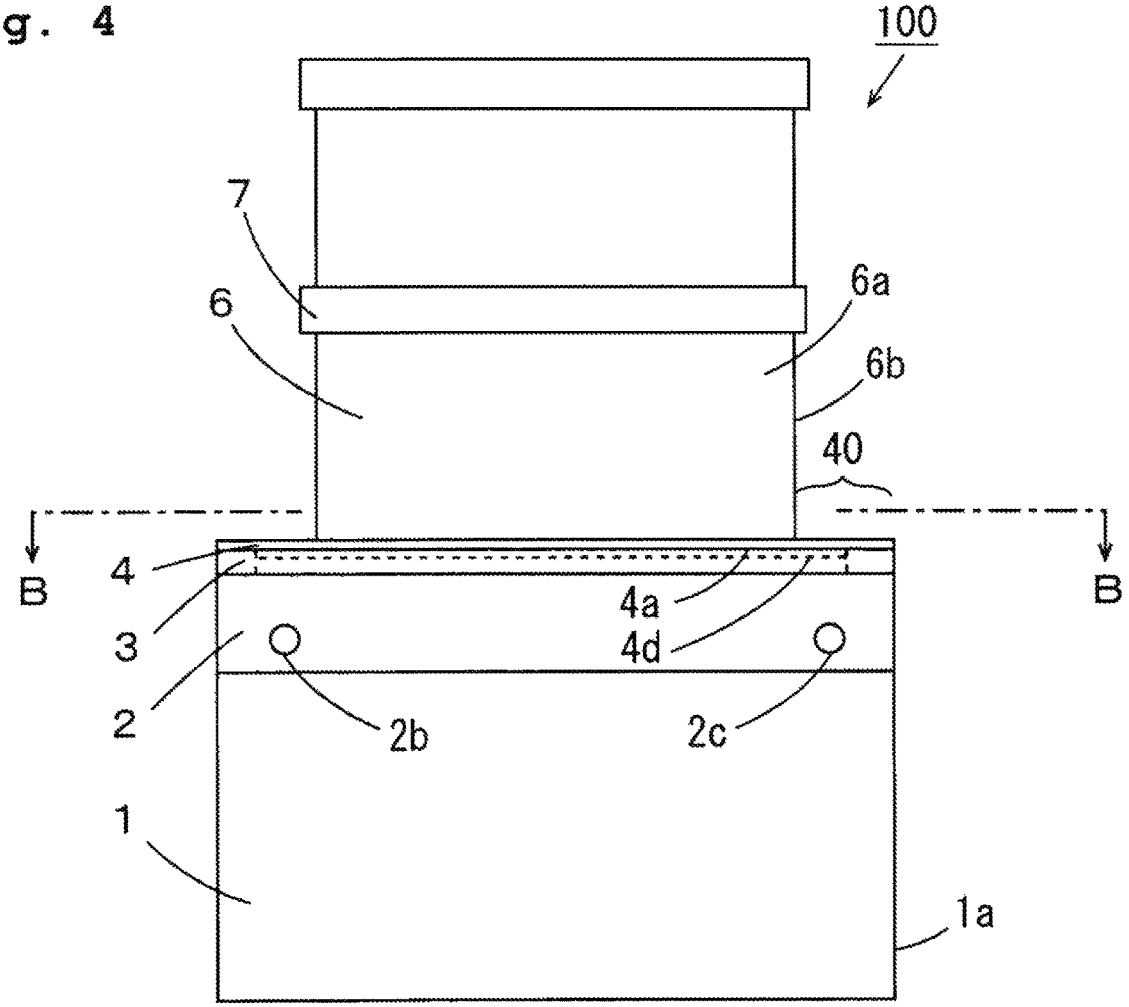
FIG. 4 is a schematic front view of a turbo-molecular pump according to a second embodiment.
Figure 5:
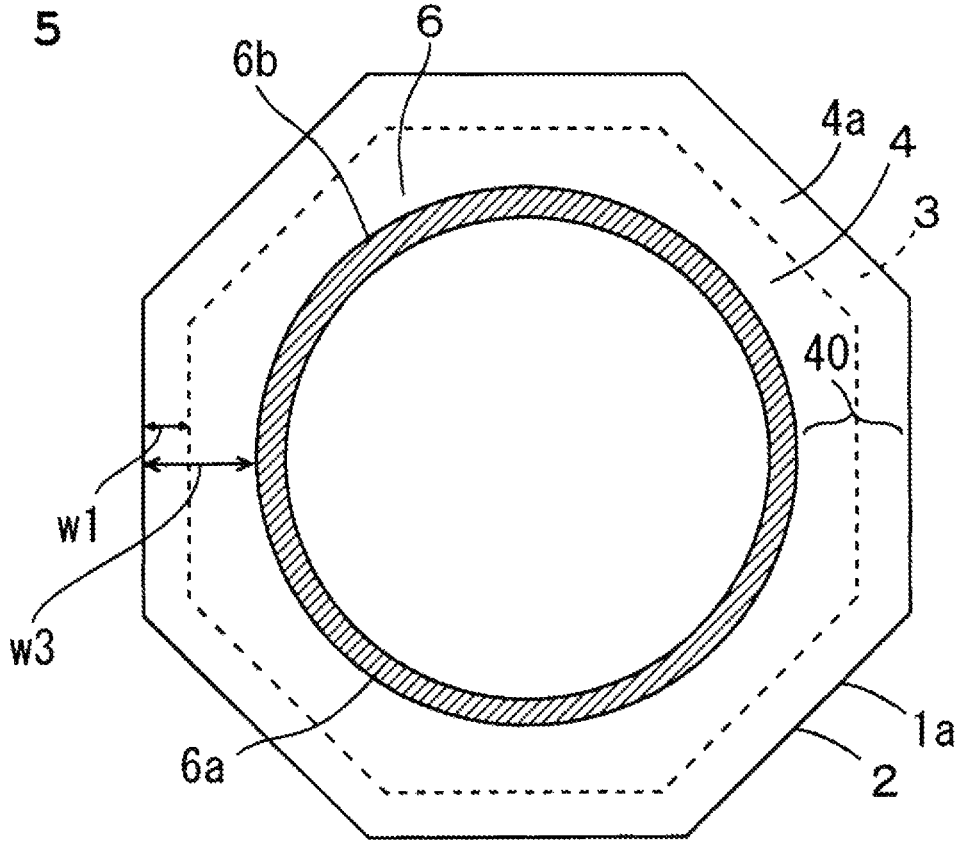
FIG. 5 is a B-B sectional view of the turbo-molecular pump of FIG. 4.

FIG. 4 is a schematic front view of a turbo-molecular pump 100 according to a second embodiment of the present invention. FIG. 5 is a B-B sectional view of the turbo-molecular pump 100 of FIG. 4. Differences of the turbo-molecular pump 100 of FIG. 4 from the turbo-molecular pump 100 of FIG. 1 are the following points.

The turbo-molecular pump 100 of FIG. 4 does not have the second heat insulating plate 5 of FIG. 1. Thus, a connection plate 4 is integrated with a case 6*a* of a pump main body 6. Moreover, a fit-in region 4*a* is formed at a lower surface 4*d* of the connection plate 4 of FIG. 4. Details of the fit-in region 4*a* will be described later. An upper surface of a first heat insulating plate 3 is fitted in the fit-in region 4*a*.

As illustrated in FIG. 5, the fit-in region 4*a* is formed along the outermost periphery of the connection plate 4. The fit-in region 4*a* is an octagonal annular recessed portion opening at an outer surface. The fit-in region 4*a* has the same width w1 as that of the first heat insulating plate 3.

Figure 6:
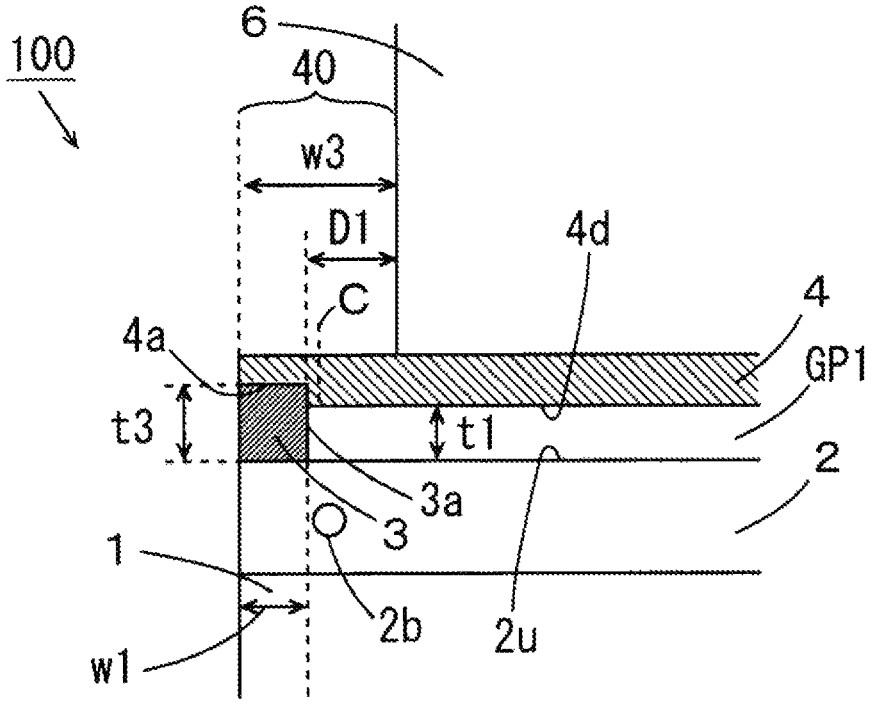
FIG. 6 is a partial enlarged sectional view of the turbo-molecular pump of FIG. 4.

FIG. 6 is a partial enlarged sectional view of the turbo-molecular pump 100 of FIG. 4. The first heat insulating plate 3 has a thickness t3. In a state in which the first heat insulating plate 3 is fitted in the fit-in region 4*a* of the connection plate 4, a lower surface of the first heat insulating plate 3 and an upper surface 2*u* of a cooler 2 contact each other, and the upper surface of the first heat insulating plate 3 and a lower surface of the fit-in region 4*a* of the connection plate 4 contact each other. Thus, a clearance GP1 surrounded by an inner peripheral surface 3*a* of the first heat insulating plate 3 is formed between the upper surface 2*u* of the cooler 2 and the lower surface 4*d* of the connection plate 4. The thickness t3 of the first heat insulating plate 3 is greater than the thickness t1 of the clearance GP1.

According to the turbo-molecular pump 100 of the second embodiment, the thickness t3 of the first heat insulating plate 3 is greater than the thickness t1 of the clearance GP1. In other words, the fit-in region 4*a* is provided so that the thickness t3 of the first heat insulating plate 3 can be increased without the need for increasing the entire height of the turbo-molecular pump 100. Consequently, the amount of heat transfer between the connection plate 4 and the cooler 2 is sufficiently reduced by the first heat insulating plate 3.

Moreover, the clearance GP1 acts as a first air heat insulating layer, and therefore, the amount of heat transfer between the cooler 2 and the connection plate 4 is sufficiently reduced by the first air heat insulating layer. Thus, the amount of heat transferred from the pump main body 6 heated by a heater 7 to the cooler 2 through the connection plate 4 is reduced.

Further, the width w1 of the first heat insulating plate 3 is sufficiently smaller than the minimum width w3 of a protruding portion 40 of the connection plate 4. That is, the area of the first heat insulating plate 3 is small. In addition, a distance between the first heat insulating plate 3 and an outer peripheral surface 6*b* of the pump main body 6 is sufficiently long. Thus, heat transfer by way of the first heat insulating plate 3 is sufficiently reduced.

As a result, the temperature of the pump main body 6 can be increased to a desired temperature in short time.

Figure 7:
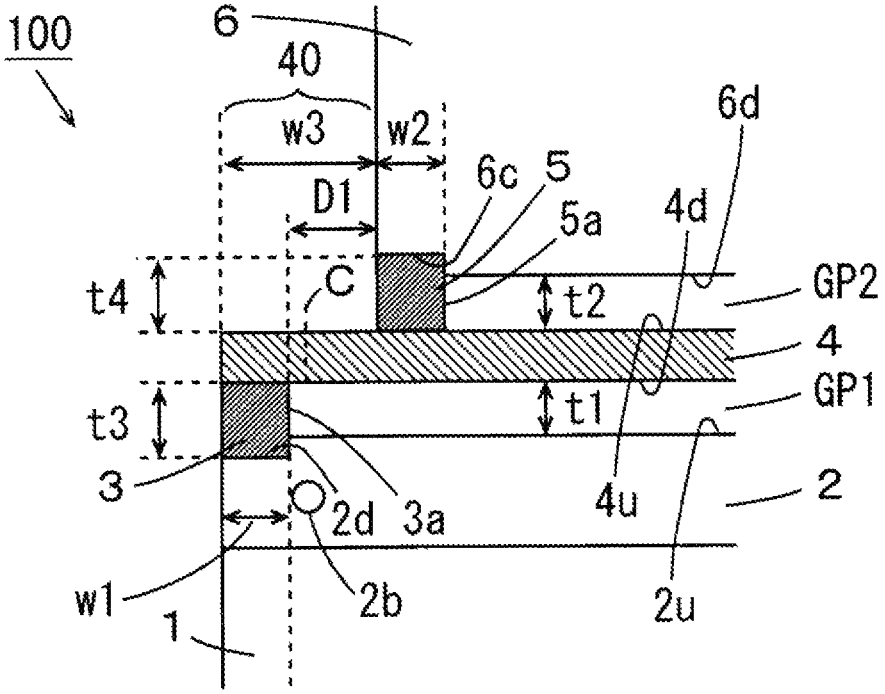
FIG. 7 is a partial enlarged sectional view illustrating another example of the turbo-molecular pump.

(3) Other Embodiments (a) FIG. 7 is a partial enlarged sectional view illustrating another example of the turbo-molecular pump 100. Differences of the turbo-molecular pump 100 of FIG. 7 from the turbo-molecular pump 100 of FIG. 3 are the following points. In the turbo-molecular pump 100 of FIG. 7, a fit-in region 2*d* (an annular recessed portion) is formed at an upper surface 2*u* of a cooler 2. A lower surface of a first heat insulating plate 3 is fitted in the fit-in region 2*d*. Moreover, a fit-in region 6*c* (an annular recessed portion) is formed at a lower surface 6*d* of a pump main body 6. An upper surface of a second heat insulating plate 5 is fitted in the fit-in region 6*c*.

The first heat insulating plate 3 has a thickness t3. In a state in which the first heat insulating plate 3 is fitted in the fit-in region 2*d* of the cooler 2, the lower surface of the first heat insulating plate 3 and an upper surface of the fit-in region 2*d* of the cooler 2 contact each other, and an upper surface of the first heat insulating plate 3 and a lower surface 4*d* of a connection plate 4 contact each other. Thus, a clearance GP1 surrounded by an inner peripheral surface 3*a* of the first heat insulating plate 3 is formed between the upper surface 2*u* of the cooler 2 and the lower surface 4*d* of the connection plate 4. The thickness t3 of the first heat insulating plate 3 is greater than the thickness t1 of the clearance GP1.

Moreover, the second heat insulating plate 5 has a thickness t4. In a state in which the second heat insulating plate 5 is fitted in the fit-in region 6*c* of the pump main body 6, a lower surface of the second heat insulating plate 5 and an upper surface 4*u* of the connection plate 4 contact each other, and the upper surface of the second heat insulating plate 5 and a lower surface of the fit-in region 6*c* of the pump main body 6 contact each other. Thus, a clearance GP2 surrounded by an inner peripheral surface 5*a* of the second heat insulating plate 5 is formed between the upper surface 4*u* of the connection plate 4 and the lower surface 6*d* of the pump main body 6. The thickness t4 of the second heat insulating plate 5 is greater than the thickness t2 of the clearance GP2.

According to the turbo-molecular pump 100 of FIG. 7, the clearance GP1 acts as a first air heat insulating layer. Thus, the amount of heat transfer between the cooler 2 and the connection plate 4 is reduced. The clearance GP2 acts as a second air heat insulating layer. Thus, the amount of heat transfer between the connection plate 4 and the pump main body 6 is reduced.

Moreover, the first heat insulating plate 3 is fitted in the fit-in region 2*d*, and therefore, the thickness t3 of the first heat insulating plate 3 is greater than the thickness t1 of the first air heat insulating layer of the clearance GP1. In other words, the fit-in region 2*d* is provided so that the thickness t3 of the first heat insulating plate 3 can be increased without the need for increasing the entire height of the turbo-molecular pump 100. Thus, the amount of heat transfer between the cooler 2 and the connection plate 4 is further reduced.

Further, the second heat insulating plate 5 is fitted in the fit-in region 6*c*, and therefore, the thickness t4 of the second heat insulating plate 5 is greater than the thickness t2 of the second air heat insulating layer of the clearance GP2. In other words, the fit-in region 6*c* is provided so that the thickness t4 of the second heat insulating plate 5 can be increased without the need for increasing the entire height of the turbo-molecular pump 100. Thus, the amount of heat transfer between the connection plate 4 and the pump main body 6 is further reduced.

Figure 8:
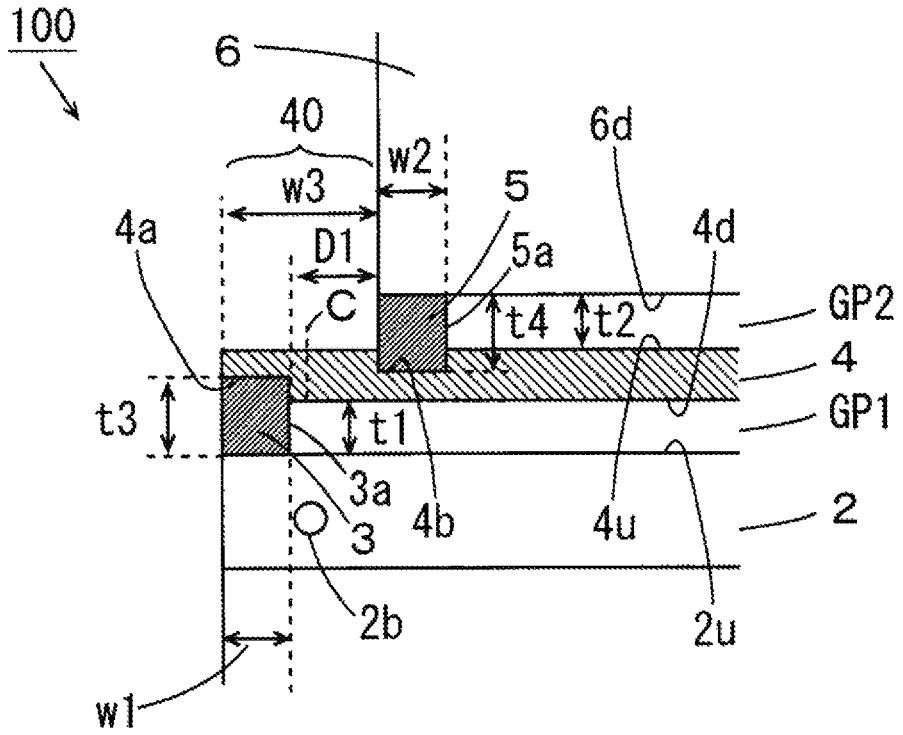
FIG. 8 is a partial enlarged sectional view illustrating still another example of the turbo-molecular pump.

(b) FIG. 8 is a partial enlarged sectional view illustrating still another example of the turbo-molecular pump 100. Differences of the turbo-molecular pump 100 of FIG. 8 from the turbo-molecular pump 100 of FIG. 7 are the following points. In the turbo-molecular pump 100 of FIG. 8, a first fit-in region 2*d* is not formed at an upper surface 2*u* of a cooler 2, and a fit-in region 4*a* (an annular recessed portion) is formed at a lower surface 4*d* of a connection plate 4. An upper surface of a first heat insulating plate 3 is fitted in the fit-in region 4*a*. Moreover, a second fit-in region 6*c* is not formed at a lower surface 6*d* of a pump main body 6, and a fit-in region 4*b* (an annular recessed portion) is formed at an upper surface 4*u* of the connection plate 4. A lower surface of a second heat insulating plate 5 is fitted in the fit-in region 4*b*. Other configurations of the turbo-molecular pump 100 of FIG. 8 are similar to those of the turbo-molecular pump 100 of FIG. 7.

According to the turbo-molecular pump 100 of FIG. 8, advantageous effects similar to those of the turbo-molecular pump 100 of FIG. 7 are obtained. Moreover, according to the turbo-molecular pump 100 of FIG. 8, both of the fit-in region 4*a* and the fit-in region 4*b* are formed at the connection plate 4, and therefore, the number of steps of manufacturing the turbo-molecular pump 100 is reduced.

(c) In the above-described embodiments, the first fit-in region is formed at either one of the upper surface 2*u* of the cooler 2 or the lower surface 4*d* of the connection plate 4, but the present invention is not limited to such a configuration. The first fit-in region may be formed at each of the upper surface 2*u* of the cooler 2 and the lower surface 4*d* of the connection plate 4.

(d) In the above-described embodiments, the second fit-in region is formed at either one of the upper surface 4*u* of the connection plate 4 or the lower surface 6*d* of the pump main body 6, but the present invention is not limited to such a configuration. The second fit-in region may be formed at each of the upper surface 4*u* of the connection plate 4 and the lower surface 6*d* of the pump main body 6.

(e) In the above-described embodiments, the first heat insulating plate 3 and the second heat insulating plate 5 are made of the resin materials, but the present invention is not limited to such a configuration. The first heat insulating plate 3 and the second heat insulating plate 5 may be made of other materials such as a rubber material having a heat insulating effect.

(f) In the above-described embodiments, the power source device 1, the cooler 2, the first heat insulating plate 3, and the connection plate 4 have the same octagonal shape as viewed in plane, but the present invention is not limited to such a configuration. The power source device 1, the cooler 2, the first heat insulating plate 3, and the connection plate 4 may have other shapes such as the same oval or rectangular shape or different oval or rectangular shapes as viewed in plane.

(g) In the above-described embodiments, the first heat insulating plate 3 is arranged along the outermost periphery of the connection plate 4, but the first heat insulating plate 3 may be arranged inward of the outermost periphery of the connection plate 4. In this case, the fit-in region 4*a* and the fit-in region 2*d* may be annular recessed portions having side surfaces at the outer and inner edges.

(h) In the above-described embodiments, the fit-in region 4*a* and the fit-in region 2*d* are, as viewed in plane, continuously provided across the entire circumference of the case 6*a* to surround the outer peripheral surface 6*b* of the pump main body 6, but may be intermittently provided. Moreover, the fit-in region 6*c* and the fit-in region 4*b* are continuously provided along the outer peripheral surface 6*b* of the pump main body 6, but may be intermittently provided.

(i) In the above-described embodiments, the case where the vacuum pump is the turbo-molecular pump 100 has been described, but the present invention is not limited to such a case. For example, the present invention is also applicable to a vacuum pump including only a drag pump (a screw groove pump) such as a Siegbahn pump or a Holweck pump, or is also applicable to a vacuum pump including a combination of a turbo-molecular pump and a drag pump.

(4) Examples and Comparative Example

For comparing a change in the temperature of the outer peripheral surface 6*b* of the pump main body 6 of the turbo-molecular pump 100, the following simulation and the following prototype test have been conducted. In a first example, the turbo-molecular pump 100 of FIG. 6 was used. In a second example, the turbo-molecular pump 100 of FIG. 7 was used.

In the first and second examples, the thickness t1 of the clearance GP1 in the pump main body 6 is 3 mm, and the thickness t3 of the first heat insulating plate 3 is 5 mm. Moreover, in the second example, the thickness t2 of the clearance GP2 in the pump main body 6 is 3 mm, and the thickness t4 of the second heat insulating plate 5 is 5 mm.

Figure 9:
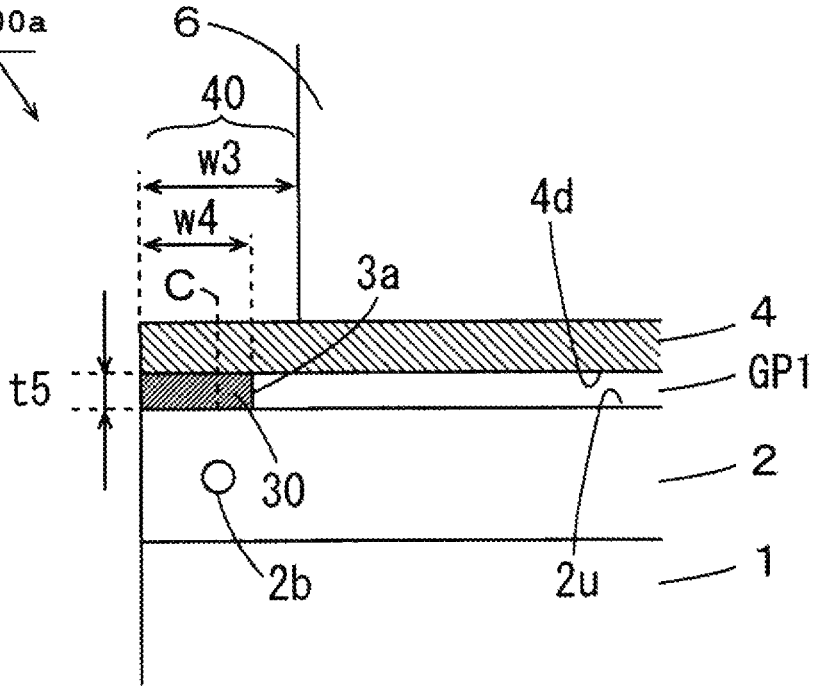
FIG. 9 is a partial enlarged sectional view of a turbo-molecular pump used in a comparative example.

FIG. 9 is a partial enlarged sectional view of a turbo-molecular pump 100*a* used in a comparative example. As illustrated in FIG. 9, a connection plate 4 is provided on an upper surface of a cooler 2 through a heat insulating plate 30 having a thickness t5. A pump main body 6 is provided on an upper surface of the connection plate 4. The width w4 of the heat insulating plate 30 is greater than ½ of the minimum width w3 of a protruding portion 40. Specifically, the areas of upper and lower surfaces of the heat insulating plate 30 of the comparative example are greater than the areas of the upper and lower surfaces of the first heat insulating plate 3 of the first and second examples by about 30%.

The lower surface of the heat insulating plate 30 and the upper surface 2*u* of the cooler 2 contact each other, and the upper surface of the heat insulating plate 30 and a lower surface 4*d* of the connection plate 4 contact each other. Thus, a clearance GP1 surrounded by an inner peripheral surface 3*a* of the heat insulating plate 30 is formed between the upper surface 2*u* of the cooler 2 and the lower surface 4*d* of the connection plate 4. The thickness of the clearance GP1 is t5. The thickness t5 of the clearance GP1 and the thickness t5 of the heat insulating plate 30 in the turbo-molecular pump 100*a* of the comparative example are 3 mm. Other configurations of the turbo-molecular pump 100*a* of the comparative example are similar to those of the turbo-molecular pump 100 of the first example.

In the simulation, the temperature of the case 6*a* of the pump main body 6 was calculated using design software under the following analysis conditions. In the prototype test, the temperature of the case 6*a* of the pump main body 6 was measured using the turbo-molecular pumps 100, 100*a* having the above-described configurations.

As the analysis conditions, the amount of heat generated from the heater 7 was 300 W, and heat radiation was an exterior convection of 13 $W/m^2 \cdot K$. Moreover, the temperature of the water-cooling jacket 2*a* of the cooler 2 was fixed to 25° C. The prototype test was conducted under the substantially same conditions as the analysis conditions. Note that in the prototype test, the heater 7 is controlled such that the temperature of the case 6*a* of the pump main body 6 does not exceed 90° C.

FIG. 10 is a table showing results of the first and second examples and the comparative example. In the simulation of the comparative example, the temperature of the case 6*a* of the pump main body 6 was 71.3° C. Moreover, in the prototype test of the comparative example, the temperature of the case 6*a* of the pump main body 6 was 70.0° C.

On the other hand, in the simulation of the first example, the temperature of the case 6*a* of the pump main body 6 was 84.7° C. Moreover, in the prototype test of the first example, the temperature of the case 6*a* of the pump main body 6 was 85.0° C. In the simulation of the second example, the temperature of the case 6*a* of the pump main body 6 was 95.0° C. Moreover, in the prototype test of the second example, the temperature of the case 6*a* of the pump main body 6 was 90.0° C.

The results of the first example and the comparative example have confirmed that by increasing the thickness t3 of the first heat insulating plate 3 and decreasing the area of the first heat insulating plate 3, the temperature of the case 6*a* of the pump main body 6 can be increased to a higher temperature.

The results of the second example and the comparative example have confirmed that by increasing the thickness t3 of the first heat insulating plate 3, decreasing the area of the first heat insulating plate 3, and providing the second heat insulating plate 5 between the pump main body 6 and the connection plate 4, the temperature of the case 6*a* of the pump main body 6 can be increased to a much higher temperature.

(5) Correspondence Between Each Component of Claims and Each Element of Embodiments Hereinafter, an example of a correspondence between each component of the claims and each element of the embodiments will be described. In the above-described embodiments, the turbo-molecular pump 100 is the example of the vacuum pump, the fit-in region 2*d* and the fit-in region 4*a* are examples of the first fit-in region, the fit-in region 6*c* and the fit-in region 4*b* are examples of the second fit-in region, the clearance GP1 is an example of a first clearance, the clearance GP2 is an example of a second clearance, the lower surface 6*d* of the pump main body 6 is an example of a first surface, the upper surface 2*u* of the cooler 2 is an example of an opposing surface or a second surface, and a view in plane is an example of a view in a first direction.

(6) Aspects

Those skilled in the art understand that the above-described multiple exemplary embodiments are specific examples of the following aspects.

(First Aspect)

A vacuum pump comprises: a pump main body; a heater provided at the pump main body; a power source device configured to supply power to the pump main body; a cooler provided between the pump main body and the power source device; a connection plate provided between the pump main body and the cooler; a first heat insulating plate arranged between the cooler and the connection plate; and a second heat insulating plate arranged between the pump main body and the connection plate.

According to a vacuum pump of a first aspect, a power source device is cooled by a cooler, and a pump main body is heated by a heater. In this case, a first heat insulating plate arranged between the cooler and a connection plate reduces heat transfer between the cooler and the connection plate. Moreover, a second heat insulating plate arranged between the pump main body and the connection plate reduces heat transfer between the pump main body and the connection plate. Thus, the amount of heat transferred from the pump main body heated by the heater to the cooler through the connection plate is reduced. As a result, the temperature of the pump main body can be increased to a desired temperature in short time.

(Second Aspect)

At least one of the cooler or the connection plate has a first fit-in region in which the first heat insulating plate is fitted. A first clearance is formed between the cooler and the connection plate. A thickness of the first heat insulating plate is greater than a thickness of the first clearance.

According to a vacuum pump of a second aspect, a first clearance formed between a cooler and a connection plate acts as a first air heat insulating layer. Generally, the coefficient of thermal conductivity of air is less than the coefficient of thermal conductivity of a solid-state material. Thus, the amount of heat transfer between the cooler and the connection plate is sufficiently reduced by the first air heat insulating layer. Moreover, a first heat insulating plate is fitted in a first fit-in region, and therefore, the thickness of the first heat insulating plate is greater than the thickness of the first clearance. Thus, the amount of heat transfer between the cooler and the connection plate is sufficiently reduced by the first air heat insulating layer.

(Third Aspect)

At least one of the pump main body or the connection plate has a second fit-in region in which the second heat insulating plate is fitted. A second clearance is formed between the pump main body and the connection plate. A thickness of the second heat insulating plate is greater than a thickness of the second clearance.

According to a vacuum pump of a third aspect, a second clearance formed between a pump main body and a connection plate acts as a second air heat insulating layer. Thus, the amount of heat transfer between the pump main body and the connection plate is sufficiently reduced by the second air heat insulating layer. Moreover, a second heat insulating plate is fitted in a second fit-in region, and therefore, the thickness of the second heat insulating plate is greater than the thickness of the second clearance. Thus, the amount of heat transfer between the pump main body and the connection plate is sufficiently reduced by the second air heat insulating layer.

(Fourth Aspect)

The pump main body has a first surface facing the connection plate and has an outer peripheral surface. The cooler has a second surface facing the connection plate. The connection plate has, as viewed in a first direction perpendicular to the first surface, a protruding portion protruding outward of the outer peripheral surface of the pump main body. The first heat insulating plate is arranged between the protruding portion and the second surface of the cooler.

According to a vacuum pump of a fourth aspect, a first heat insulating plate is arranged between a cooler and a protruding portion of a connection plate, and therefore, a path from a pump main body to the cooler by way of a second heat insulating plate, the connection plate, and the first heat insulating plate is extended. Thus, the amount of heat transferred from the pump main body to the cooler through the first heat insulating plate is further reduced. Moreover, a clearance is formed between the cooler and a center portion of the connection plate excluding the protruding portion. According to this configuration, the clearance between the cooler and the center portion of the connection plate acts as an air heat insulating layer, and therefore, the amount of heat transfer between the cooler and the connection plate is sufficiently reduced. Thus, heat transfer in the shortest path between the pump main body and the cooler is sufficiently reduced.

(Fifth Aspect)

The protruding portion is, as viewed in the first direction, formed to at least partially surround the outer peripheral surface of the pump main body. The first heat insulating plate is, as viewed in the first direction, continuously or intermittently provided to at least partially surround the outer peripheral surface of the pump main body. The second heat insulating plate is, as viewed in the first direction, continuously or intermittently provided along the outer peripheral surface of the pump main body.

According to a vacuum pump of a fifth aspect, a clearance is formed between a cooler and a center portion of a connection plate, and a clearance is formed between a pump main body and the center portion of the connection plate. The clearance between the cooler and the center portion of the connection plate acts as a first air heat insulating layer, and the clearance between the pump main body and the center portion of the connection plate acts as a second air heat insulating layer. Thus, heat transfer in the shortest path between the pump main body and the cooler is sufficiently reduced by the first and second air heat insulating layers. Moreover, heat transfer between the pump main body and the cooler in a circumferential direction of the pump main body is sufficiently and uniformly reduced by the first and second heat insulating plates.

(Sixth Aspect)

A vacuum pump comprises: a pump main body; a heater provided at the pump main body; a power source device configured to supply power to the pump main body; a cooler provided between the pump main body and the power source device; a connection plate provided between the pump main body and the cooler; and a first heat insulating plate arranged between the cooler and the connection plate. At least one of the cooler or the connection plate has a first fit-in region in which the first heat insulating plate is fitted. A first clearance is formed between the cooler and the connection plate. A thickness of the first heat insulating plate is greater than a thickness of the first clearance.

According to a vacuum pump of a sixth aspect, a power source device is cooled by a cooler, and a pump main body is heated by a heater. A first heat insulating plate is fitted in a first fit-in region, and a first clearance is formed between the cooler and a connection plate. In the above-described configuration, the thickness of the first heat insulating plate is greater than the thickness of the first clearance. Thus, the amount of heat transfer between the connection plate and the cooler is sufficiently reduced by the first heat insulating plate. Moreover, the first clearance acts as a first air heat insulating layer, and therefore, the amount of heat transfer between the cooler and the connection plate is sufficiently reduced by the first air heat insulating layer. Thus, the amount of heat transferred from the pump main body heated by the heater to the cooler through the connection plate is reduced. As a result, the temperature of the pump main body can be increased to a desired temperature in short time.

(Seventh Aspect)

The pump main body has an outer peripheral surface. The cooler has an opposing surface facing the connection plate. The connection plate has, as viewed in a first direction perpendicular to the opposing surface, a protruding portion formed to protrude outward of the outer peripheral surface of the pump main body. The first fit-in region is provided at at least one of the cooler or the protruding portion. The first heat insulating plate is arranged between the cooler and the protruding portion with the first heat insulating plate being fitted in the first fit-in region.

According to a vacuum pump of a seventh aspect, a first heat insulating plate is arranged between a cooler and a protruding portion of a connection plate. Thus, a path from a pump main body to the cooler by way of the connection plate and the first heat insulating plate is extended. Thus, the amount of heat transferred from the pump main body to the cooler through the first heat insulating plate is further reduced. Moreover, a first clearance is formed between the cooler and a center portion of the connection plate excluding the protruding portion. Thus, the first clearance between the cooler and the center portion of the connection plate acts as an air heat insulating layer, and therefore, the amount of heat transfer between the center portion of the connection plate and the cooler is sufficiently reduced. Consequently, heat transfer in the shortest path between the pump main body and the cooler is sufficiently reduced.

(Eighth Aspect)

The protruding portion is, as viewed in the first direction, formed to at least partially surround the outer peripheral surface of the pump main body. The first fit-in region is, as viewed in the first direction, continuously or intermittently provided at at least one of the cooler or the protruding portion to at least partially surround the outer peripheral surface of the pump main body. The first heat insulating plate is arranged between the cooler and the protruding portion with the first heat insulating plate being fitted in the first fit-in region.

According to a vacuum pump of an eighth aspect, heat transfer between a pump main body and a cooler in a circumferential direction of the pump main body is sufficiently and uniformly reduced by a first heat insulating plate.

(Ninth Aspect)

A width of the first heat insulating plate is, as viewed in the first direction, equal to or less than a half of a minimum width of the protruding portion.

According to a vacuum pump of a ninth aspect, the width of a first heat insulating plate arranged between a cooler and a protruding portion of a connection plate is sufficiently smaller than that of the protruding portion, and therefore, heat transfer between the cooler and the connection plate by way of the first heat insulating plate is sufficiently reduced.

(Tenth Aspect)

A distance between an inner edge portion of the first heat insulating plate and the outer peripheral surface of the pump main body is, as viewed in the first direction, equal to or greater than the half of the minimum width of the protruding portion.

According to a vacuum pump of a tenth aspect, a distance between a first heat insulating plate and an outer peripheral surface of a pump main body is sufficiently long, and therefore, the amount of heat from the pump main body to a cooler through a connection plate and the first heat insulating plate is sufficiently reduced.

What is claimed is:

1. A vacuum pump comprising:

a pump main body;

a heater provided at the pump main body;

a power source device configured to supply power to the pump main body;

a cooler provided between the pump main body and the power source device;

a connection plate provided between the pump main body and the cooler;

a first heat insulating plate arranged between the cooler and the connection plate; and a second heat insulating plate arranged between the pump main body and the connection plate, wherein a first clearance comprising a thickness t1 is formed between the cooler and the connection plate, a first heat insulating plate is in contact with each of the cooler and the connection plate, and is located within the first clearance, wherein a second clearance comprising a thickness t2 is formed between the connection plate and the pump main body, a second heat insulating plate is in contact with each of the connection plate and the pump main body, and is located within the second clearance.

2. The vacuum pump according to claim 1, wherein at least one of the cooler or the connection plate has a first fit-in region in which the first heat insulating plate is fitted, a first clearance is formed between the cooler and the connection plate, and a thickness of the first heat insulating plate is greater than a thickness of the first clearance.

3. The vacuum pump according to claim 1, wherein at least one of the pump main body or the connection plate has a second fit-in region in which the second heat insulating plate is fitted, a second clearance is formed between the pump main body and the connection plate, and a thickness of the second heat insulating plate is greater than a thickness of the second clearance.

4. The vacuum pump according to claim 1, wherein the pump main body has a first surface facing the connection plate and has an outer peripheral surface, the cooler has a second surface facing the connection plate, the connection plate has, as viewed in a first direction perpendicular to the first surface, a protruding portion protruding outward of the outer peripheral surface of the pump main body, and the first heat insulating plate is arranged between the protruding portion and the second surface of the cooler.

5. The vacuum pump according to claim 4, wherein the protruding portion is, as viewed in the first direction, formed to at least partially surround the outer peripheral surface of the pump main body, the first heat insulating plate is, as viewed in the first direction, continuously or intermittently provided to at least partially surround the outer peripheral surface of the pump main body, and the second heat insulating plate is, as viewed in the first direction, continuously or intermittently provided along the outer peripheral surface of the pump main body.

6. A vacuum pump comprising:

a pump main body;

a heater provided at the pump main body;

a power source device configured to supply power to the pump main body;

a cooler provided between the pump main body and the power source device;

a connection plate provided between the pump main body and the cooler; and a first heat insulating plate arranged between the cooler and the connection plate, wherein at least one of the cooler or the connection plate has a first fit-in region in which the first heat insulating plate is fitted, the first fit-in region being a recessed portion having a same width in a radial direction as that of the first heat insulating plate, a first clearance is formed between the cooler and the connection plate, and a thickness of the first heat insulating plate is greater than a thickness of the first clearance.

7. The vacuum pump according to claim 6, wherein the pump main body has an outer peripheral surface, the cooler has an opposing surface facing the connection plate, the connection plate has, as viewed in a first direction perpendicular to the opposing surface, a protruding portion formed to protrude outward of the outer peripheral surface of the pump main body, the first fit-in region is provided at at least one of the cooler or the protruding portion, and the first heat insulating plate is arranged between the cooler and the protruding portion with the first heat insulating plate being fitted in the first fit-in region.

8. The vacuum pump according to claim 7, wherein the protruding portion is, as viewed in the first direction, formed to at least partially surround the outer peripheral surface of the pump main body, the first fit-in region is, as viewed in the first direction, continuously or intermittently provided at at least one of the cooler or the protruding portion to at least partially surround the outer peripheral surface of the pump main body, and the first heat insulating plate is arranged between the cooler and the protruding portion with the first heat insulating plate being fitted in the first fit-in region.

9. The vacuum pump according to claim 4, wherein a width of the first heat insulating plate is, as viewed in the first direction, equal to or less than a half of a minimum width of the protruding portion.

10. The vacuum pump according to claim 9, wherein a distance between an inner edge portion of the first heat insulating plate and the outer peripheral surface of the pump main body is, as viewed in the first direction, equal to or greater than the half of the minimum width of the protruding portion.

11. The vacuum pump according to claim 7, wherein a width of the first heat insulating plate is, as viewed in the first direction, equal to or less than a half of a minimum width of the protruding portion.

12. The vacuum pump according to claim 11, wherein a distance between an inner edge portion of the first heat insulating plate and the outer peripheral surface of the pump main body is, as viewed in the first direction, equal to or greater than the half of the minimum width of the protruding portion.

* * * * *